United States Patent [19]

Bofinger et al.

[11] Patent Number: 4,975,030

[45] Date of Patent: Dec. 4, 1990

[54] FUEL INJECTION PUMP FOR INTERNAL COMBUSTION ENGINES

[75] Inventors: Günter Bofinger, Vaihinger; Claus Maier, Ludwigsburg; Gerhard Reichan, Stuttgart, all of Fed. Rep. of Germany

[73] Assignee: Robert Bosch GmbH, Stuttgart, Fed. Rep. of Germany

[21] Appl. No.: 347,777

[22] PCT Filed: Nov. 6, 1987

[86] PCT No.: PCT/DE87/00498

§ 371 Date: Apr. 21, 1989

§ 102(e) Date: Apr. 21, 1989

[87] PCT Pub. No.: WO88/04726

PCT Pub. Date: Jun. 30, 1988

[30] Foreign Application Priority Data

Dec. 23, 1986 [DE] Fed. Rep. of Germany ..... 3644150

[51] Int. Cl.[5] ..... F04B 7/04

[52] U.S. Cl. ..... 417/498; 123/496; 417/499

[58] Field of Search ..... 417/498, 499, 500; 123/496

[56] References Cited

U.S. PATENT DOCUMENTS

| | | | |
|---|---|---|---|
| 4,083,662 | 4/1978 | Höfer et al. | 123/503 X |
| 4,172,699 | 10/1979 | Häfele | 417/499 |
| 4,476,835 | 10/1984 | Laufer | 417/500 X |
| 4,711,221 | 12/1987 | Laufer | 123/496 X |
| 4,763,631 | 8/1988 | Fehlmann et al. | 123/496 X |

FOREIGN PATENT DOCUMENTS 203862 4/1985 Japan .

*Primary Examiner*—Stephen M. Hepperle
*Attorney, Agent, or Firm*—Michael J. Striker

[57] ABSTRACT

A fuel injection pump for internal combustion engines comprising a pump plunger displaceable in a pump cylinder for delivering fuel to a plurality of injection locations, and elements for controlling fuel injection quantity. The controlling elements include a relief channel in the pump plunger for communicating a pump working space defined by the pump plunger with a relief chamber, an outlet port on an outer surface of the pump plunger for communicating the relief channel with the relief chamber, at least two connecting cross-sections of different shape for communicating the relief chamber with the outer port, and a slide valve displaceable along the outer surface of the plunger and having a control edge for controlling flow of fuel through the connecting cross-sections during a delivery stroke of the pump plunger.

5 Claims, 1 Drawing Sheet

FUEL INJECTION PUMP FOR INTERNAL COMBUSTION ENGINES

BACKGROUND OF THE INVENTION

The invention relates to from a fuel injection pump German Offengungsschrift 2,522,374 discloses a fuel injection pump having recesses which defines connecting cross-sections in the circumferential surface of the pump plunger, which recesses, starting at the outlet ports of the relief channel, extend towards the side of the pump working chamber. Rectangular recesses, inter alia, have been proposed which have a width differing from one another in the peripheral direction of the pump plunger and, furthermore, also differ in their axial extension, their length. With such an arrangement, during the course of an opening stroke of the pump plunger, a bent cross-sectional profile is to be achieved in such a way that, after initially restricted relief via one of the connecting ports, the relief cross-section is enlarged by the arrival of the second connecting port. In the connect-control cross-sections provided here, the restricting action occurring at different speeds of the fuel injection pump is especially emphasized. These control cross-sections are provided in particular for adaption of the fuel injection quantity as a function of the speed. Here, one of the connecting cross-sections is regularly constructed in the manner of a restricting slot.

In internal combustion engines working with spontaneous ignition, it is necessary for the low-load range, in particular the idling range, for the fuel to be introduced into the combustion chamber with exact timing but long spray duration so that so called knocking of the internal combustion engine, especially noticeable in this area, is prevented. The long duration of the injection ensures that the fuel quantity introduced during the ignition lag does not become too large and thus not too much fuel is burnt suddenly, which would lead to a steep pressure rise causing knocking. In order to achieve a long injection duration, many proposals are already known which predominantly have the feature in common that, during the duration of the delivery, a portion of the fuel delivered under high pressure is introduced into a discharge chamber which is defined by a movable wall. This means considerable expense, the discharge volume in addition having to be controlled for the various operating ranges of the internal combustion engine.

SUMMARY OF THE INVENTION

The object of the invention is to provide, a the fuel injection pump the advantage in which increase in the duration of injection is achieved by a very simple measure. The object of the invention is achieved by forming a connecting cross-section which, before the actual outlet port becomes effective and before the end of the high-pressure delivery phase, allows some of the fuel delivered under high pressure to flow off during every pump plunger stroke. This is effective in the lower speed range and, the idling range up to a low-load operating range. Towards high speeds and towards a full-load operation, the control effectiveness of this connecting cross section, acting in a restricting manner, decreases so that a sufficiently short injection duration is available in this operating range. Here, the fuel injection pump requires only a slight change in the area of the outlet ports.

The invention as to its construction so to its mode of operation, together with additional objects and advantages thereof, will be best understood from the following detailed description of the preferred embodiments with reference to the appended drawings.

DESCRIPTION THE PREFERRED EMBODIMENTS

Figure 1:
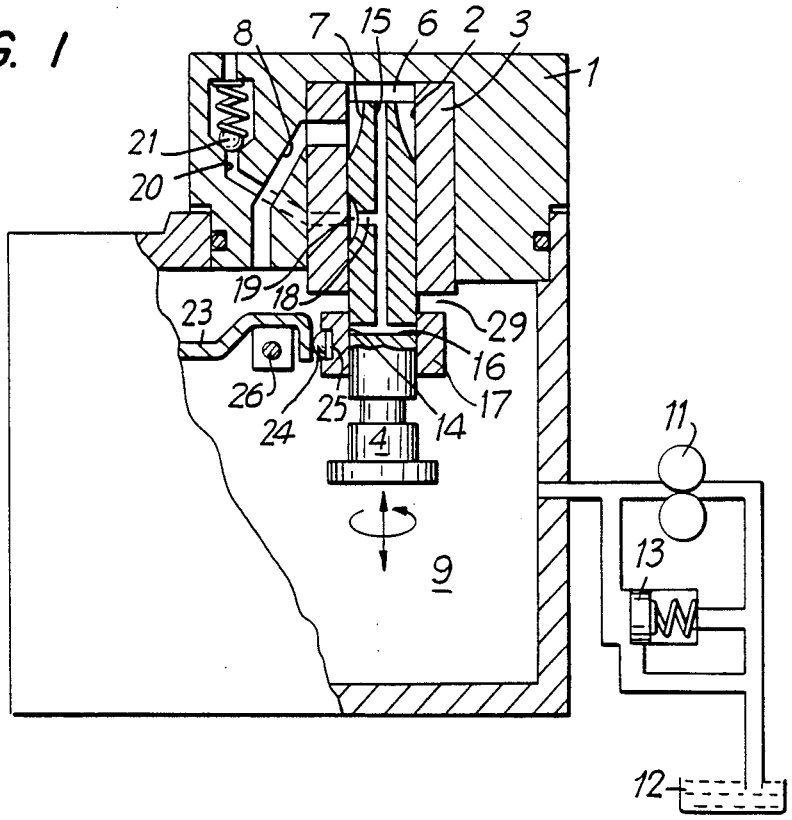
FIG. 1 shows schematically a partial cross-sectional view of a distributor fuel injection pump according to the present invention.

In a housing 1 of a fuel injection pump, a pump plunger 4, which is set in a reciprocating and at the same time rotating motion against the force of a restoring spring (not shown) by means (not shown), is movable in a bore defining a pump cylinder 2 of a cylinder barrel 3 inserted into the pump housing. In the pump cylinder 2, the pump plunger encloses at the end thereof a pump working chamber 6 which, via longitudinal grooves 7, arranged in the circumferential surface of the pump plunger and leading at the end face into the pump working chamber 6, and a channel 8 running through the cylinder barrel 3 in the housing 1, is supplied with fuel from a suction chamber 9 inside the fuel injection pump as long as the pump plunger executes its suction stroke or assumes its bottom dead center position. The suction chamber 9 is supplied with fuel from a fuel supply tank 12 via a delivery pump 11. By a pressure control valve 13, the pressure in the suction chamber 9 is controlled in a known manner as a function of speed so that the pressure in the suction chamber increases as speed increases. This especially applies if, e.g., a spray adjusting device for controlling the start of injection is to be actuated by means of the speed-dependent suction chamber pressure.

Leading off from the pump working chamber 6 in the pump plunger as relief channel 15 is a coaxial blind bore which, in the lower pump plunger part protruding out of the pump cylinder 2, leads via a transverse bore 16 into the pump suction chamber 9. The outlet ports 14 of the transverse bore 16 are controlled by an annular slide valve 17 interacting with the pump plunger. Furthermore, branching off from the relief channel 15 in the pump plunger part lying in the area of the pump cylinder 2 is a radial bore 18 which leads into a distributor port 19, designed as a longitudinal groove in the circumferential surface of the pump plunger. Via the relief channel 15, the radial bore 18 and the distributor port 19, one of several pressure lines 20 is connected to the pump working chamber 6 in each case during a delivery stroke of the pump plunger after the latter, by its rotation, has closed the connection between channel 8 and the longitudinal groove 7. The pressure lines 20 each lead via a non-return valve 21 to individual fuel injection nozzles of the cylinders of an internal combustion engine (not shown) and are arranged in a distributed manner on the periphery of the pump cylinder 2 in accordance with the number of cylinders to be supplied. During the delivery stroke of the pump plunger, fuel is thus delivered to the injection nozzles via the relief channel 15 as long as the outlet ports 14 of the transverse bore 16 remain closed by the annular slide valve 17.

The annular slide valve 17, via a governor 23, which, with a head 24, engages into a recess 25 of the annular slide valve and is pivotable about a spindle 26, is displaced in a tightly fitting manner on the pump plunger as a function of load and speed by a speed governor (not shown further). During this procedure, a displacement of the head 24 downwards towards the drive side of the pump plunger causes the outlet ports 14 of the transverse bore 16, during the delivery stroke of the pump plunger, to be opened in a controlled manner at an earlier partial stroke of the pump plunger from the start of the delivery stroke, whereupon the pump working chamber 6 is relieved, and no more fuel can be delivered under high pressure into the presure lines 20. Accordingly, with the adjustment in this direction, the fuel injection quantity is reduced. In the uppermost position of the annular slide valve 17, the outlet ports 14 are no longer opened during the delivery stroke of the pump plunger, so that the entire fuel quantity which can be delivered by the pump plunger 4 reaches injection. This position can correspond to a full-load position or the position in which an excess fuel quantity is to be delivered for the starting operation of the internal combustion engine. In the last-mentioned case, the position, in accordance with the full-load quantity, is slightly lower than the full-load position.

Figure 2:
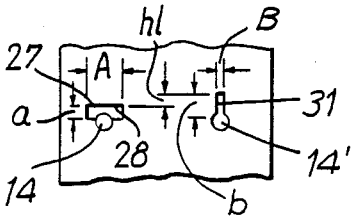
FIG. 2 shows a developed view of the pump plunger circumferential surface in the area of the quantity adjusting member of a fuel injection pump show in FIG. 1 with a first embodiment of outlet ports and connecting ports.

A projection of a pump plunger circumferential surface is shown in FIG. 2 with the outlet ports 14 of the transverse channel 16. What is difficult to represent graphically in FIG. 1 is here clearly shown. One of the outlet ports 14 is in connection with a rectangular first connecting cross-section 27 which is made as a recess in the circumferential surface of the pump plunger. Here, the first connecting cross-section has a larger width A than height a. In addition, this rectangular recess 27 extends towards the pump working chamber 6 and has towards the pump working chamber a straight boundary edge 28 which extends as parallel to the control edge 29 of the annular slide valve 17. In the exemplary embodiment, this control edge is formed by the end face of the annular slide valve 17 and extends in a radial plane relative to the axis of the pump plunger. The other outlet port 14' of the transverse bore is connected to a second connecting cross-section 31 which likewise extends towards the pump working chamber 6 and has a rectangular shape. In this case, the width B lying in the peripheral direction, unlike the width A of the first connecting cross-section 27, is of very narrow configuration. The longitudinal extent b in the direction of the pump working chamber of the second connecting cross-section 31 is here larger than the longitudinal extent a of the first connecting cross-section 27. The recess forming the second connecting cross section 31 thus protrudes beyond the first connecting cross-section 27 and, with its dimensioning, is designed as a restriction. Here, the restricting effect can be achieved by the small width B and/or the small depth of the recess forming the second connecting cross-section 31. During the delivery stroke of the pump plunger on account of the dimensioning described, the second connecting cross-section 31 comes into connection with the suction chamber 9 before the first connecting cross-section 27, by the stroke hl, the difference between b and a. Via the leakage distance hl thus created, a partial quantity of the delivered fuel can therefore flow off before the final relief of the pump working chamber 6 via the first connecting cross-section 27, so that a fuel quantity smaller than the delivered fuel quantity reaches injection. Accordingly, the injection rate is low and a prolonged delivery duration of the pump plunger is necessary to introduce a certain fuel quantity. This is effected by the setting of the annular slide valve 10 by the governor.

Figure 3:
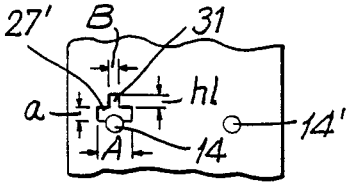
FIG. 3 shows a developed view of the pump plunger circumferential surface with a second embodiment of the outlet ports and connecting cross-sections of the same pump plunger surface.

In the design shown in FIG. 3, the second connecting cross-section 31 has been integrated with the first connecting cross-section 27, i.e., on a connecting cross-section 27' of the same shape as in the exemplary embodiment in FIG. 2, the part of the second connecting cross-section 31 protruding in the axial direction in FIG. 2 with the length hl, has been attached in such a way as to adjoin the boundary edge 28.

Figure 4:
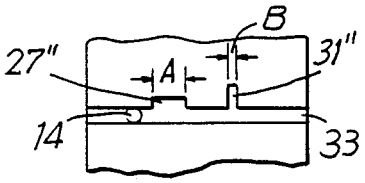
FIG. 4 shows a developed view of the circumferential surface of the pump plunger including a third embodiment of the connecting cross-sections.

In the third exemplary embodiment in FIG. 4, the pump plunger is provided with an annular groove 33 which is made in the circumferential surface in the area of the outlet port 14. A first connecting cross section 27'' and a second connecting cross-sections 31'' now branch off from this annular groove 33 similarly to FIG. 2. The dimensioning of these cross-sections corresponds to the exemplary embodiment in FIG. 2.

Figure 5:
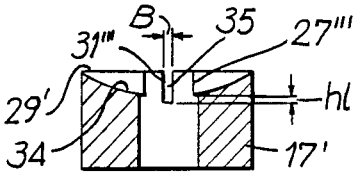
FIG. 5 shows a sectional view of an annular slide valve, designed as a quantity adjusting member, which is a modification of the annular slide valve of FIG. 1 representing a fourth exemplary embodiment of the invention.

Now instead of providing the connecting cross-sections on the circumferential surface of the pump plunger, they can also be made in the annular slide valve, as shown by FIG. 5. This design requires the pump plunger to have an annular groove 33, as already provided in FIG. 4. The outlet ports 14 of the transverse channel 16 lead into this annular groove. On the annular slide valve, a first connecting cross-section 27''' and a second connecting cross-section 31''' are now made in the circumferential surface. These connecting cross-sections are produced by grooves which are made, e.g. ground in, from the end face 29' of the annular slide valve. Thus two diametrically opposite first grooves 34 are provided which, e.g., can be produced in a single operation with a milling cutter, and, displaced by 90° relative thereto, second grooves 35 can be milled in. In this arrangement, the first grooves, similarly to FIG. 2, together have a width which results in the width A of the first connecting cross-section 27 in FIG. 2, and the second grooves 35 together have a width B' which corresponds to the width B of the second connecting cross-section 31 in FIG. 2. The depth of the grooves again differs by the amount hl by which the second connecting cross-section 31''' comes into connection with the annular groove on the pump plunger before the first grooves 34. The mode of operation is analagous to that described with reference to FIGS. 2 to 4.

Compared with the exemplary embodiment in FIG. 2, the embodiments in FIGS. 3, 4 and 5 have the advantage that they can also be used in fuel injection pumps which have only one outlet port 14 on the pump plunger. This occurs in particular when, such as, e.g., in German Offenlegungsschrift 3,424,883, two relief channels are provided having only one outlet port each in the area of the annular slide valve on the pump plunger. In the embodiment in FIG. 4, it is especially advantageous that here a symmetric pressure distribution at the pump plunger can be produced so that, when high pressure is applied, the slide value can be displaced on the pump plunger in such a way that the forces are balanced.

Compared with the abovementioned embodiments, the design in FIG. 5 has the advangtage that the connecting cross-section does not have to be eroded but can be produced by plunge-cut grinding. In addition, a symmetric distribution of forces at the pump plunger can be achieved here.

While the invention has been illustrated and described as embodied in a fuel injection pump for internal combustion engine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A fuel injection pump for internal combustion engines and comprising a relief chamber; a pump cylinder; a pump plunger having an outer surface and displaceable in said pump cylinder for delivering fuel to a plurality of injection locations and defining in said pump cylinder a pump working chamber; and means for controlling fuel injection quantity delivered by said pump plunger, said controlling means including a relief channel located in said pump plunger and communicating said pump working chamber with said relief chamber, an outlet port located on said outer surface of said plunger for communicating said relief channel with said relief chamber, at least two connecting cross-sections of different shapes for communicating said relief chamber with said outlet port, a slide valve displaceable along said outer surface of said plunger and having a control edge for controlling flow of fuel through said at least two connecting cross-sections during a delivery stroke of said pump plunger, and means for displacing said slide valve in accordance with a required fuel injection quantity, one of said at least two connecting cross-sections having a reduced section defining a restriction and the other of said at least two connecting cross-sections having a larger section which does not act as a restriction, and said one of said at least two connecting cross-sections attaining communication with said relief chamber during the delivery stroke of said pump plunger before the other of said at least two connecting cross-sections attains communication with said relief chamber, each of said at least two connecting cross-sections having a rectangular shape and a boundary edge extending parallel to said control edge of said slide valve, and said one of said at least two cross-sections being progressively controlled along a length of an axial extent thereof, at least until the other of said at least two cross-sections is being controlled.

2. A fuel injection pump according to claim 1, wherein said pump plunger is reciprocally and rotatably displaceable in said pump cylinder and acts as a distributor of delivered fuel, and said slide valve displacing means comprising a governor.

3. A fuel injection pump according to claim 2, wherein said one of said at least two connecting cross-sections is formed integrally on the other of said at least two connecting cross-sections and extends beyond the other of said at least two connecting cross-sections in a direction of the delivery movement of said pump plunger.

4. A fuel injection pump for internal combustion engines and comprising a relief chamber; a pump cylinder; a pump plunger having an outer surface and displaceable in said pump cylinder for delivering fuel to a plurality of injection locations and defining in said pump cylinder a pump working chamber; and means for controlling fuel injection quantity delivered by said pump plunger, said controlling means including a relief channel located in said pump plunger and communicating said pump working chamber with said relief chamber, an outlet port located on said outer surface of said plunger for communicating said relief channel with said relief chamber, at least two connecting cross-sections of different shapes for communicating said relief chamber with said outlet port, a slide valve displaceable along said outer surface of said plunger and having a control edge for controlling flow of fuel through said at least two connecting cross-sections during a delivery stroke of said pump plunger, and means for displacing said slide valve in accordance with a required fuel injection quantity, one of said at least two connecting cross-sections having a reduced section defining a restriction and the other of said at least two connecting cross-sections having a larger section which does not act as a restriction, and said one of said at least two connecting cross-sections attaining communication with said relief chamber during the delivery stroke of said pump plunger before the other of said at least two connecting cross-sections attains communication with said relief chamber, each of said at least two connecting cross-sections having a rectangular shape and a boundary edge extending parallel to said control edge of said slide valve, and said one of said at least two cross-sections being progressively controlled along a length of an axial extent thereof, at least until the other of said at least two cross-sections is being controlled, said pump plunger having an annular groove on said outer surface thereof, said outlet port communicating with said annular groove, each of said at least two connecting cross-sections comprising a recess extending from said annular groove, said one of said at least two connecting cross-sections extending in a direction of the delivery movement of said pump plunger beyond the other of said at least two connecting cross-sections.

5. A fuel injection pump for internal combustion engines and comprising a relief chamber; a pump cylinder; a pump plunger having an outer surface and displaceable in said pump cylinder for delivering fuel to a plurality of injection locations and defining in said pump cylinder a pump working chamber; and means for controlling fuel injection quantity delivered by said pump plunger, said controlling means including a relief channel located in said pump plunger and communicating said pump working chamber with said relief chamber, an outlet port located on said outer surface of said plunger for communicating said relief channel with said relief chamber, at least two connecting cross-sections of different shapes for communicating said relief chamber with said outlet port, a slide valve displaceable along said outer surface of said plunger and having a control edge for controlling flow of fuel through said at least two connecting cross-sections during a delivery stroke of said pump plunger, and means for displacing said slide the valve in accordance with a required fuel injection quantity, one of said at least two connecting cross-sections having a reduced section defining a restriction and the other of said at least two connecting cross-sections having a larger section which does not act as a restriction, and said one of said at least two connecting cross-sections attaining communication with said relief chamber during the delivery stroke of said pump plunger before the other of said at least two connecting cross-sections attains communication with said relief chamber, each of said at least two connecting cross-sections having a rectangular shape and a boundary edge extending parallel to said control edge of said slide valve, and said one of said at least two cross-sections being progressively controlled along a length of an axial extent thereof, at least until the other of said at least two cross-sections is being controlled, said pump plunger having on said outer surface thereof an annular groove, said outlet port communicating with said annular groove, said slide valve having an inner circumferential surface, a first narrow restricting longitudinal groove formed on said inner circumferential surface, extending from said control edge in a displacement direction of said pump plunger and defining said one of said at least two connecting cross-sections, and a second non-restricting groove formed on said inner circumferential surface, extending from said control edge in the displacement direction of said pump plunger and defining said other of said at least two connecting cross-sections, said first groove extending beyond said second groove by a length of a leakage distance of the delivery stroke of said pump plunger measured in the displacement direction of said pump plunger.

* * * * *